US006155087A

United States Patent [19]

Necchi

[11] Patent Number: 6,155,087

[45] Date of Patent: Dec. 5, 2000

[54] REDUCED-ENCUMBRANCE ANTI-THEFT CASE, PARTICULARLY FOR COMPACT DISKS, MUSICASSETTES VIDEOCASSETTES AND THE LIKE

[76] Inventor: Pietro Necchi, Via Dante 7, I-15013 Borgoratto Alessandrino, Italy

[21] Appl. No.: 09/168,397

[22] Filed: Oct. 6, 1998

Related U.S. Application Data

[63] Continuation of application No. PCT/EP97/05113, Sep. 18, 1997, abandoned.

[30] Foreign Application Priority Data

Feb. 14, 1997 [IT] Italy ..... TO97A0120

[51] Int. Cl.[7] ..... B65D 85/57

[52] U.S. Cl. ..... 70/57.1; 70/58; 70/63; 70/276; 206/1.5; 206/308.2; 206/387.11

[58] Field of Search ..... 70/57.1, 58, 63, 70/276; 206/1.5, 308.2, 387.11

[56] References Cited

U.S. PATENT DOCUMENTS

| | | | |
|---|---|---|---|
| 2,436,531 | 2/1948 | Shipley . | |
| 3,942,630 | 3/1976 | Phillips | 206/1.5 |
| 4,113,098 | 9/1978 | Howard | 206/540 |
| 4,174,034 | 11/1979 | Hoo | 206/1.5 |
| 4,634,004 | 1/1987 | Mortensen | 206/387 |
| 5,147,034 | 9/1992 | Broadhead et al. | 206/1.5 |
| 5,209,086 | 5/1993 | Brühlwiler | 70/57.1 |
| 5,769,218 | 6/1998 | Yabe | 206/308.2 |
| 5,944,173 | 8/1999 | Boire et al. | 206/1.5 |

FOREIGN PATENT DOCUMENTS

| | | | |
|---|---|---|---|
| 0 312 172 | 4/1989 | European Pat. Off. . | |
| 0 402 822 | 12/1990 | European Pat. Off. . | |
| 0 508 201 | 10/1992 | European Pat. Off. . | |
| 0 616 103 | 9/1994 | European Pat. Off. . | |
| 605769 | 6/1926 | France | 206/1.5 |
| 609179 | 9/1948 | United Kingdom | 206/1.5 |
| WO93/15294 | 8/1993 | WIPO | 70/58 |
| WO94/09234 | 4/1994 | WIPO . | |

*Primary Examiner*—Lloyd A. Gall
*Attorney, Agent, or Firm*—Paul & Paul

[57] ABSTRACT

There is disclosed a reduced-encumbrance anti-theft case (1) for compact disks, musicassettes, videocassettes and the like, comprising a containing box (5), a movable abutment member (7, 7') and a locking and unlocking device (11, 11') of the abutment member (7, 7'). The box (5) is comprised of: an upper and a lower face (15, 17) substantially C-shaped; a rear holding wall (19) connected to the two faces (15, 17); and two elongated front holding walls (25, 27) connected to corresponding ends of the two upper and lower faces (15, 17). The abutment member (7, 7') is longitudinally slidingly connected to the lower face (17) and has a C-shape similar thereto. In a closing position, an engagement end (47) of the abutment member (7, 7') and the second holding wall (27) cooperate with the item (3) to prevent its undesired removal from the case (1).

8 Claims, 4 Drawing Sheets

FIG. 3
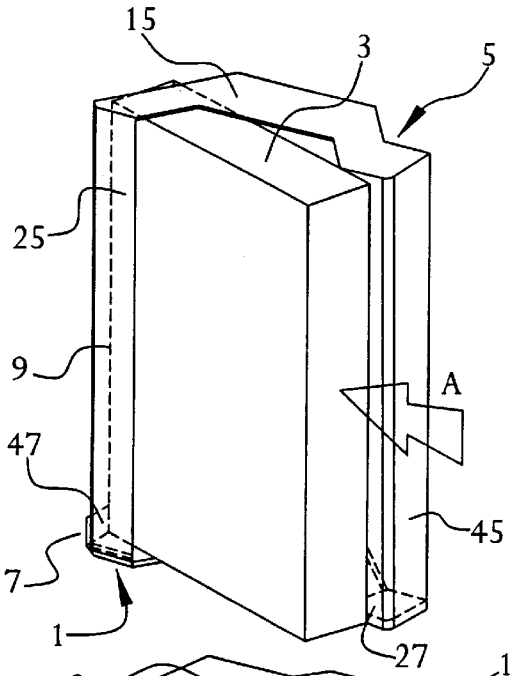
FIG. 4
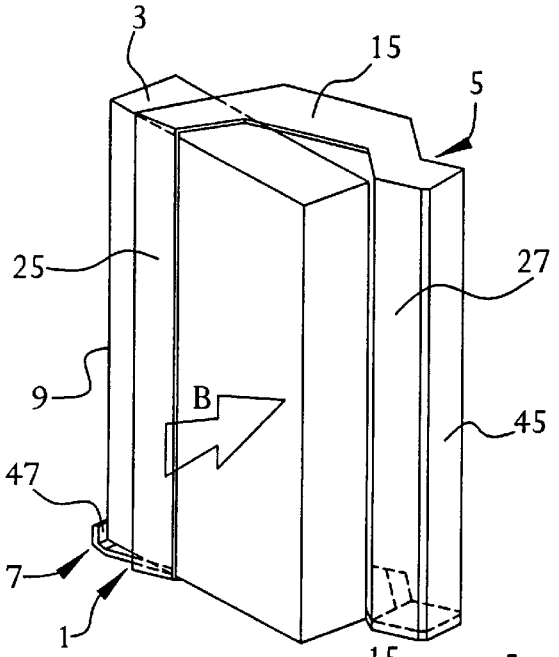
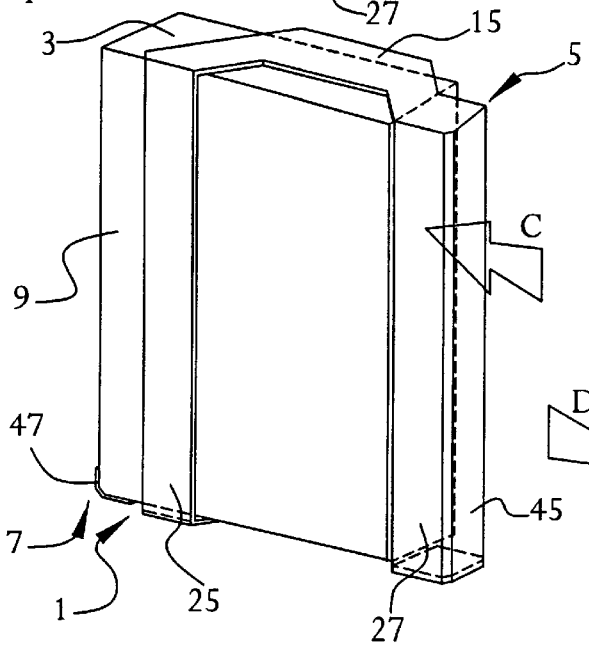
FIG. 5
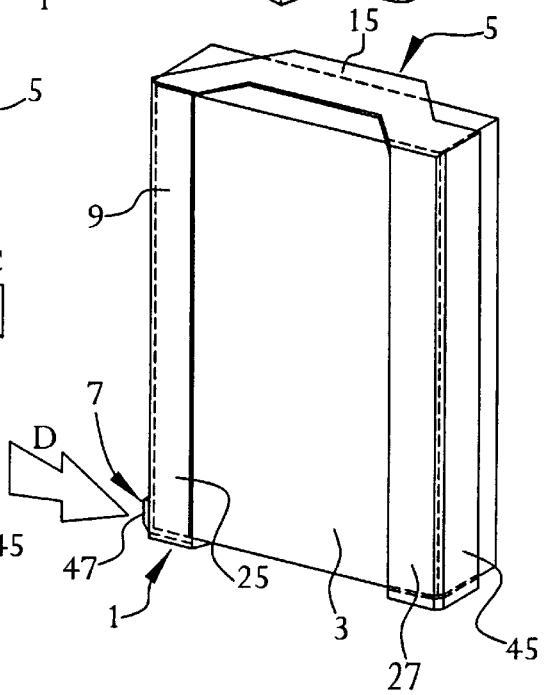
FIG. 6

REDUCED-ENCUMBRANCE ANTI-THEFT CASE, PARTICULARLY FOR COMPACT DISKS, MUSICASSETTES VIDEOCASSETTES AND THE LIKE

CROSS-REFERENCE TO RELATED APPLICATIONS

This is a continuation of International Application PCT/EP97/05113, filed Sep. 18, 1997 which designated the Untied States and is now abandoned, which is based on Italian Patent Application TO97A000120 filed Feb. 14, 1997.

BACKGROUND OF THE INVENTION

The present invention refers to a reduced-encumbrance anti-theft case, that can be used particularly to protect compact disks, musicassettes, videocassettes and similar items that are commercially available in different types of stores.

Various types of anti-theft cases are known in the art, the most recent and widespread of which is disclosed in EP-A-0402822, that is the preamble of claim 1. This anti-theft case is characterized by the following features:

- it is composed of a box substantially shaped as a parallelepiped that is equipped with an insertion window for the cassette next to at least one of its faces;
- such window leaves at least two sidewall portions next to two opposite sides of the face;
- the length of the box opening, in the cassette-insertion direction, that is between these two sides, is greater than the length of the cassette itself;
- a movable abutment member cooperating with the cassette head is provided inside the case in the area of one of the two sidewall portions: this member can alternatively assume an active abutment position, advanced towards the cassette, and an inactive releasing position away from the cassette; and
- a locking and unlocking device to take the movable abutment member from its active abutment position to its inactive releasing position.

Though being quite satisfactory for the applications for which it is provided, the anti-theft case disclosed in EP-A-0402822 has overall dimensions that are slightly greater than the ones of the cassette that it must protect. Since usually anti-theft cases are delivered to commercial users (and the same cases are stored by such users waiting to be employed) in relevant amounts, the total encumbrance of a delivery and/or storage batch of anti-theft cases is very high, with correspondingly high transport or storage costs.

Object of the present invention is solving the above prior art problems, providing an anti-theft case that, in addition to being efficient and sturdy as typical for a protective case (and thereby remaining unaltered with respect to prior art as regards these protective features), has reduced overall dimensions when it is stacked together with other cases of the same type for transport and/or storage.

Due to its particular arrangement, the case of the present invention provides both for the loading of the item to be protected in an inclined (or even longitudinal) direction with respect to the case itself, and for the movable abutment member displacement in a longitudinal, and not transverse, direction with respect to the case, as instead occurs in prior art anti-theft cases. Due to these two further combined features, it is possible to realize the simultaneous functions of reduced encumbrance and efficient anti-theft.

Another object of the present invention, obtained by adopting a second embodiment both of the movable abutment member and of the locking and unlocking device, is further reducing the overall encumbrance of the anti-theft case, eliminating the projection in which the known embodiment of the locking and unlocking device was housed. In fact, the new locking and unlocking device can be housed inside the anti-theft case itself, without occupying a great deal of space, and thus eliminating the need for the above projection on the bottom side of the case.

Another object of the present invention in the above second embodiment thereof is providing an abutment member/locking and unlocking device arrangement through which it is impossible to break free the item to be protected by applying a sudden, strong force to the anti-theft case in an attempt to make the abutment member go out of the case itself. In fact, the abutment member can be freed from the locking and unlocking device only by carrying out two separate actions, that is, by pushing the abutment member inwards and by applying a magnetic attraction force to the locking and unlocking device to unlock it from the abutment member.

The above and other objects and advantages of the invention, as will appear from the following description, are obtained with a reduced-encumbrance anti-theft case as disclosed in claim 1.

BRIEF DESCRIPTION OF THE DRAWINGS

The present invention will be better described by some preferred embodiments thereof, provided as a non-limiting example, with reference to the enclosed drawings, in which:

FIG. 3 is a perspective view of the first step of a possible way of inserting an item into the anti-theft case in FIG. 1;

FIG. 4 is a perspective view of the second step of a possible way of inserting an item into the anti-theft case in FIG. 1;

FIG. 5 is a perspective view of the third step of a possible way of inserting an item into the anti-theft case in FIG. 1;

FIG. 6 is a perspective view of the fourth and last step of a possible way of inserting an item into the anti-theft case in FIG. 1;

DETAILED DESCRIPTION OF THE PREFERRED EMBODIMENT

Figure 1:
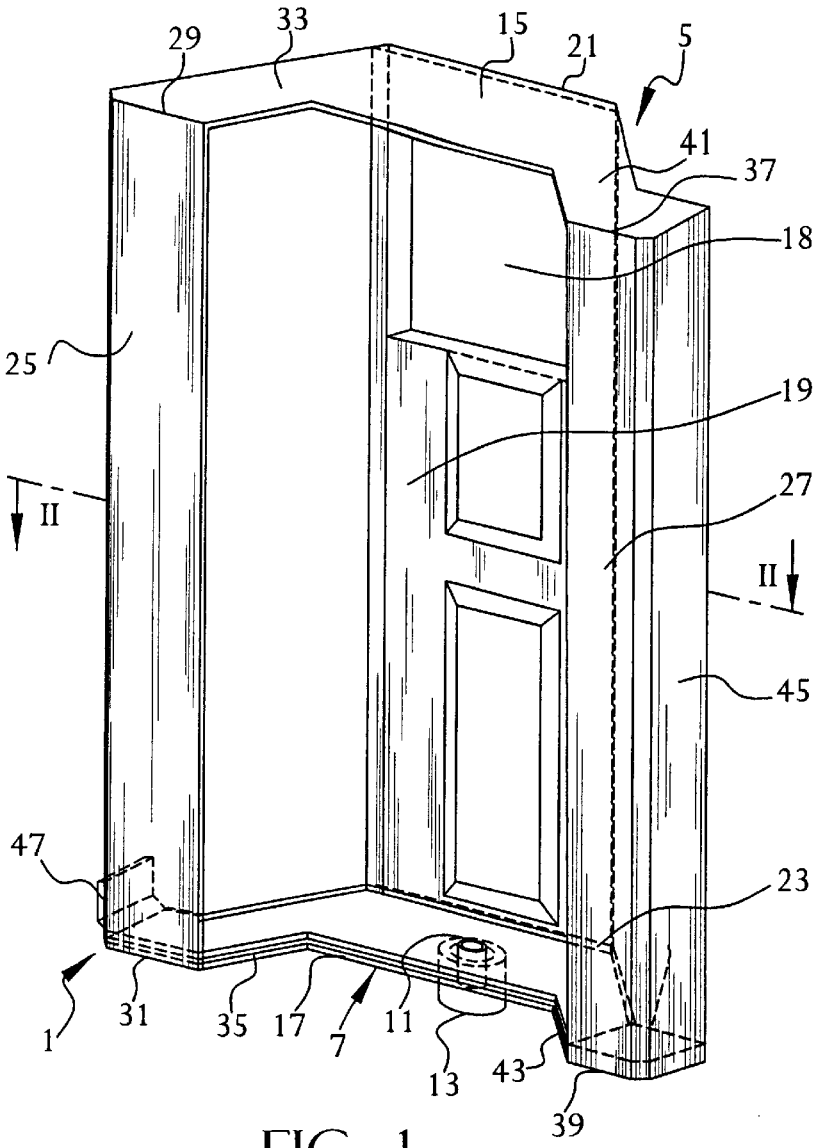
FIG. 1 is a side perspective view of the reduced-encumbrance anti-theft case according to the present invention with a first embodiment of its movable abutment member and its locking and unlocking device.
Figure 2:
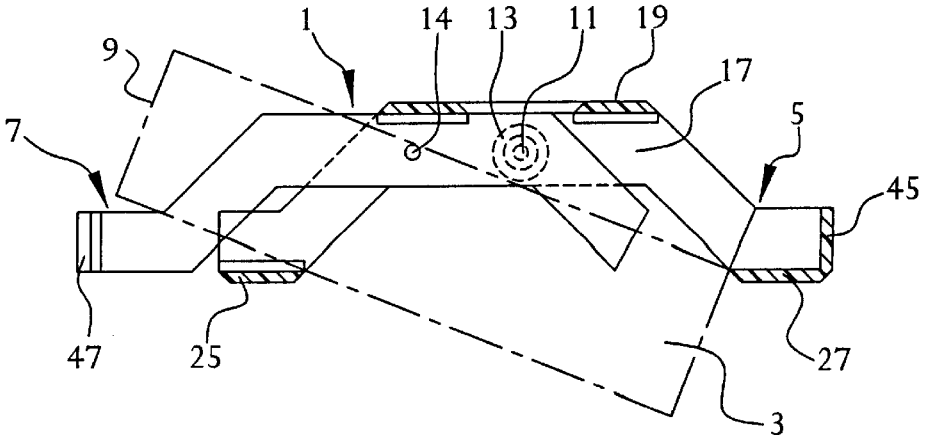
FIG. 2 is a top sectional view taken along line II—II of the anti-theft case in FIG. 1, where the insertion method of an item to be protected can be understood.
Figure 7:
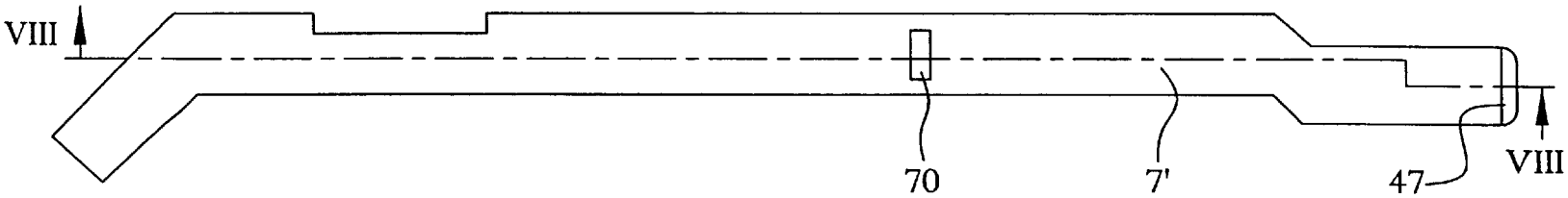
FIG. 7 is a top view of a second embodiment of the movable abutment member and of the locking and unlocking device of the anti-theft case of the present invention.

With reference to the Figures, and in particular to FIGS. 1 and 2, there is shown the reduced-encumbrance anti-theft case 1 according to the present invention, that is adapted to contain and protect items 3, in particular compact disks (simple and double ones), musicassettes, videocassettes, CD-ROM, Play-stations® and the like. The embodiment shown in the Figures is the one that can be used to contain and protect videocassettes 3, but obviously, through the adequate sizings and adaptations, the case 1 will be appliable to all the other types of mentioned items, and other similar ones, without departing from the scope of the present invention.

The anti-theft case 1 is substantially composed of a box 5 to contain the item 3 to be protected, and of a movable abutment member 7 adapted to cooperate with the head 9 of this item 3 when inserting it inside the box 5 in order to prevent the extraction of item 3 from box 5. The anti-theft case 1 finally comprises a locking and unlocking device 11 to take the movable abutment member 7 from its active abutment position in which the item 3 is unmovably inserted into the box 5 to its inactive releasing position in which the item 3 is able to be removed from the box 5. The locking and unlocking device 11 in a first embodiment thereof is of known shape and configuration, for example from the above-mentioned document EP-A-0402822, and therefore it will not be described in much detail in this specification: in the first embodiment shown, it is represented by a small known cylinder 11 that slides into a cylindrical seat 13 formed into one of the sides of box 5 and penetrates into an hole 14 (that in other not shown embodiments could be a variously-shaped slot or cavity suitable to contain and hold the similarly-shaped small cylinder 11) drilled into the abutment member 7 in order to keep it secured when it is in its closing position. In order to facilitate the understanding of the case 1 of the present invention, all other necessary parts to make the small cylinder 11 operate, have been omitted from the Figures (like for example the thrust spring or check members, that are mandatory for it to correctly operate), since they can be easily deduced from the above-mentioned prior art documents. Obviously, other configuration and arrangements of such device 11 are possible, as will immediately appear to the skilled person in the art.

In order to allow the anti-theft case 1 to keep its theft-prevention characteristics, but to simultaneously occupy a reduced space when it is stacked or piled up with other cases of the same type, the box 5, of which such case 1 is composed, has been realized in a particular way suitable for this purpose. In particular, the box 5 is composed of an upper face 15, substantially C-shaped, whose maximum overall dimensions are slightly greater than the one of the item 3 to be protected. This obviously occurs because the upper face 15 must be able to contain the item 3 preventing the undesired removal thereof. The face 15 has been designed as upper one because this is the orientation that it assumes when it is necessary to remove the item 3 from the box 5, as is best shown in FIGS. 3 to 6. Under a normal position, instead, when the item 3 remains into the box 5 of the case 1 and this case 1 is resting on a display shelf, the upper face 15 is in practice the lower one, on which the case 1 itself is resting in a vertical position.

The box 5 is then equipped with a lower face 17 (for which the above orientation considerations are valid in reverse), also substantially C-shaped, possibly different from the shape of the upper face 15. The maximum overall dimensions of the lower face 17 are also obviously slightly greater than the ones for the item 3.

The two upper and lower faces 15 and 17 are mutually linked, on one side, by means of a rear holding wall 19: the rear holding wall 19 is shaped in different ways (one of which, that recalls the shape of an H, is shown in the Figures) and is connected to the two corresponding longer sides 21, 23 of the C, respectively of the upper 15 and lower 17 faces.

Moreover, the two upper and lower faces 15 and 17 are linked, on the other side, by two front holding walls 25, 27: the first one, 25, of these two front holding walls is connected to the two corresponding ends 29, 31, respectively, of one 33, 35 of the two shorter arms of the C respectively of the upper 15 and lower 17 faces, while the second one, 27, of the front holding walls is connected to the two corresponding ends 37, 39, respectively, of the other one 41, 43 of the two shorter arms of the C respectively of the upper 15 and lower 17 faces.

The second front holding wall 27 has an L-shaped cross section so that it abuts, with one of its sides 45 corresponding to one of the two arms of the L, against the item 3 when it is completely inserted in order to prevent its removal from the box 5.

In the embodiment shown, the movable abutment member 7 is provided with the shape of a C, substantially similar to the shape of the lower face 17, to which it is slidably connected. Moreover, the movable abutment member 7 is equipped with a side engagement end 47 positioned with respect to the box 5 on the opposite side with respect to the one where the second front holding wall 27 is provided: the side engagement end 47 is adapted to cooperate with the head 9 of the item 3 in order to prevent its removal from the case 1 at the end of the complete insertion of the item 3 into the case 1 itself, as will be better seen afterwards. On the lower face 17, the locking and unlocking device 11 suitable to cooperate with the movable abutment member 7 is also placed, externally with respect to the box 5.

The movable abutment member 7 is slidable inside the case 1 in a longitudinal direction with respect to the case 1 itself (with respect to the plane of the sheet in the Figures): this sliding is necessary to allow inserting and removing the item 3 to be protected into the adequately shaped case 1 of the present invention. Moreover, this sliding makes the case 1 of the present invention different from the other prior art cases, where movable abutment members 7 all operate and slide transversally with respect to the case 1 itself (with respect to the plane of the sheet in the Figures).

In a known way, the anti-theft case 1 of the present invention is then equipped with electronic devices (not shown) or the like, to signal the possible theft of the item 3; these signalling devices are usually located inside a recess 18, adequately and commonly formed into the rear holding wall 19.

With the above-described configuration for the box 5, or with similar configurations deriving from small constructive variations that all pertain to the scope of the invention, it is possible to stack a plurality of anti-theft cases 1 with a very limited final encumbrance: the reduction that can be obtained from this configuration is such that at least two (and even more, according to the applications) inventive stacked cases 1 substantially occupy the same overall space along their height as one prior art case.

With reference now to FIGS. 3 to 6, a possible, preferred insertion procedure of an item 3 into the reduced-encumbrance anti-theft case 1 of the present invention will be described.

In a known way, it is first necessary to disengage the movable abutment member 7 by downwards displacing the locking and unlocking device 11 (for example by attracting it with a magnetic device, like those that can be found by the desk in most supermarkets) so that it can be disengaged from the hole 14 formed into the movable abutment member 7, thus freeing it and allowing it to longitudinally slide.

As shown in FIG. 3, the item 3 is then inserted in an inclined position with respect to the case 1 making the item 3 slide along the direction shown by arrow A till its head 9 comes in contact with the side engagement end 47 of the movable abutment member 7. After that, the item 3 is simultaneously pushed along the direction B in FIG. 4 and the direction C in FIG. 5, in order to make the movable abutment member 7 slide, with the locking and unlocking device 11 in its disengagement position, being opened in the maximum side sliding position shown in FIG. 5. Obviously, this maximum side sliding position when opening can also be obtained through a manual displacement of the movable abutment member 7 by operating on its side engagement end 47.

After that, as shown in FIG. 6, the item 3 is pushed when closing along the direction of arrow D, together with the movable abutment member 7, till it is housed inside the box 5 into an unmovable position, in contact on one hand with the side 45 of the second front holding wall 27, and on the other hand with the side engagement end 47. The movable abutment member 7 is then secured by taking the locking and unlocking device 11 in its engagement position with the member 7 inside the hole 14, and the insertion step of item 3 inside case 1 is completed.

Obviously, to remove item 3 from case 1, the above-listed procedural steps must be carried out in the reverse sequence, starting from the disengagement of the movable abutment member 7.

The procedure described in FIGS. 3 to 6 is only one possible, preferred way of inserting the item 3 into the case 1. Obviously, the item 3 can be inserted into the case 1 also by longitudinally sliding the item 3 into the case 1 once the abutment member 7 has been moved to its opened, disengagement position. This is due to the fact that the side engagement end 47 of the abutment member 7 is short and does not cover the whole height of the item 3 itself: therefore, once having moved the abutment member 7 out of the case 1, the whole side of the case 1 facing the side engagement end 47 is free and completely open, and it is from this side that the item 3 can be longitudinally inserted along a direction that is parallel to the case 1 itself. Since this way of inserting the item 3 into the case 1 can be easily understood once having seen the arrangement of the case 1 of the present invention, it will not be further described in detail.

With reference now to FIGS. 7 to 11, a second inventive embodiment of both the movable abutment member and the locking and unlocking device will be described, taking into account that nothing changes with respect to the operation of the anti-theft case 1 of the present invention, as has been shown in FIGS. 3 to 6.

This other locking and unlocking device 11', shown in FIGS. 7 to 11, is composed of an lamellar spring 11' that is fixed (for example by glueing, welding, etc.) on one of its ends to the lower face 17 of the box 5, while the other one of its ends can freely be raised upwards/downwards (looking at the plane of the sheet in the Figures) by the resilient strength of the spring itself, in order to make contact with the movable abutment member 7' to keep it in contact with the item 3 in order to unremovably close the item 3 inside the box 5. On the other hand, the spring 11' is also able to move downwards (always looking at the plane of the sheet) when attracted, for example, by a magnet (not shown) or similar attraction means, in order to free the movable abutment member 7', allowing it to slide externally to the box 5 to be able to remove the item 3 from the box 5.

This other movable abutment member 7', shown in FIGS. 7 to 11, has the same C-shape as the former abutment member 7, the only difference being a recess 70 formed approximately in the central part thereof. The cross-sectional shape of the recess 70 is particular, since it must be able to perform three functions: firstly, it must unmovably house the new locking and unlocking device 11' in its closing position; secondly, it must prevent tampering with the case 1 and therefore it must provide such an arrangement that nobody can undesirably free the abutment member 7', for example by beating the case against a hard object (or vice versa) and by overcoming the strength of the locking and unlocking device 11'; and thirdly it must allow an easy disengagement of the locking and unlocking device 11' from the movable abutment member 7', such disengagement being carried out both by a first manual pushing operation and by a second automatic attraction operation performed through suitable means (not shown).

To be able to satisfy all three above requirements, the recess 70 in the movable abutment member 7', as best shown in FIG. 8 to 11, has an inclined plane 72 on which the lamellar spring 11' will rest when it is in its final upward position, and a projection 74 that prevents the spring 11' from being dislodged from the recess 70 by sudden, brusque unwanted actions, like the beating thereof against a hard object. Through the projection 74 the lamellar spring 11' will be securely housed inside the recess 70 until a manual pressure along the direction of arrow E in FIG. 9 will free the spring 11' letting it be attracted downwards by the attraction means. The movable abutment member 7' is further equipped with a first tooth 76 whose function is abutting against the free end of the lamellar spring 11', and therefore stopping the movable abutment member 7' when it is removed from the box 5 when extracting the item 5, thus preventing the abutment member 7' from falling out of the box 5. Finally, the movable abutment member 7' is further equipped with a second tooth 78, whose function is keeping a spring 80 engaged against the abutment member 7': this spring 80 acts to provide an outward-pushing force to the abutment member 7', this force serving both to remove the abutment member 7' from its engagement with the item 3, and to keep the locking and unlocking device 11' securely inserted inside the recess 70 when in its closing position. It is this light force that must be overcome when manually pushing the abutment member 7' as a first step to remove the item 3 from the box 5.

To better clarify what has been described above, the four possible stages of the relationship between movable abutment member 7' and locking and unlocking device 11' will be described with reference to FIGS. 8 to 11, respectively.

Figure 8:
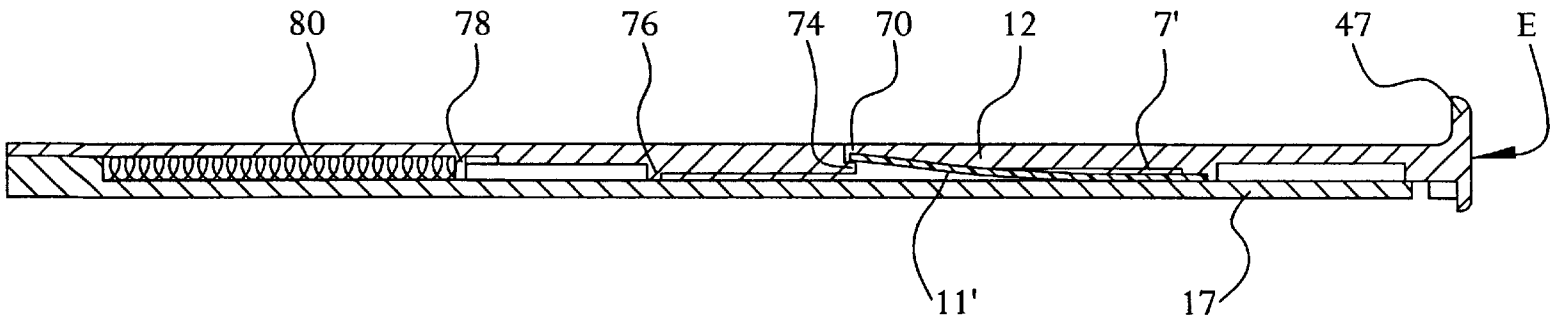
FIG. 8 is a side sectional view taken along line VIII—VIII in FIG. 7 particularly showing a first possible cooperation stage between locking and unlocking device and movable abutment member.

FIG. 8 shows the stage in which the lamellar spring (locking and unlocking device) 11' is fully inserted into the recess 70 of the abutment member 7'.

Figure 9:
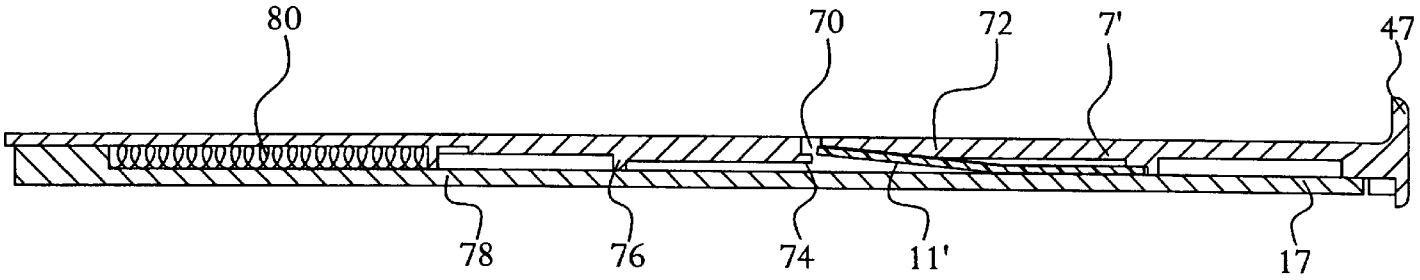
FIG. 9 is a view similar to FIG. 8 particularly showing a second possible cooperation stage between locking and unlocking device and movable abutment member.

In FIG. 9, a manual pressure on the side engagement end 47 of the abutment member 7' has been applied along the direction shown by arrow E, overcoming the light force of the spring 80: due to this pressure, the abutment member 7' is moved leftward (with respect to the Figure) and the free end of the lamellar spring 11' is freed from the engagement with the projection 74 and can be attracted downwards (with respect to the Figure) by the attraction means adequately located below the case 1.

Figure 10:
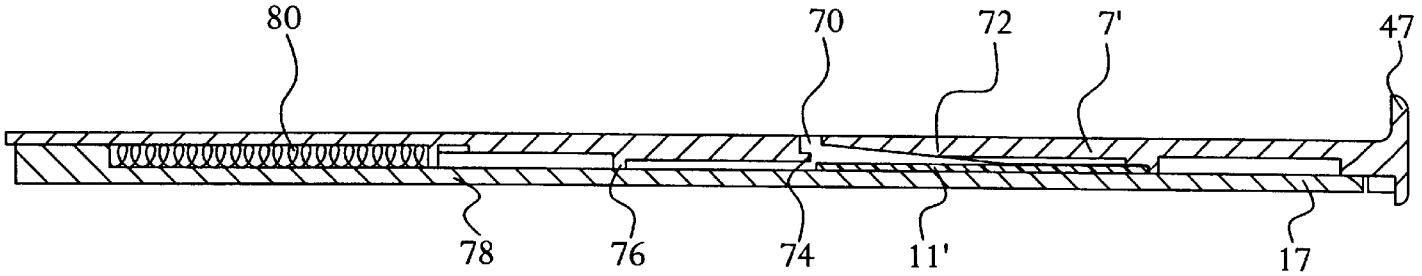
FIG. 10 is a view similar to FIG. 8 particularly showing a third possible cooperation stage between locking and unlocking device and movable abutment member.

FIG. 10 shows the situation that occurs when the attraction means have attracted the lamellar spring 11' downwards till the spring 11' has reached a substantially parallel position with respect to the lower face 17 of the box 5. The abutment member 7', being thus free from its engagement with the spring 11', can be pushed rightward by the force of the spring 80 to allow the following removal of the item 3 from the box 5.

Figure 11:
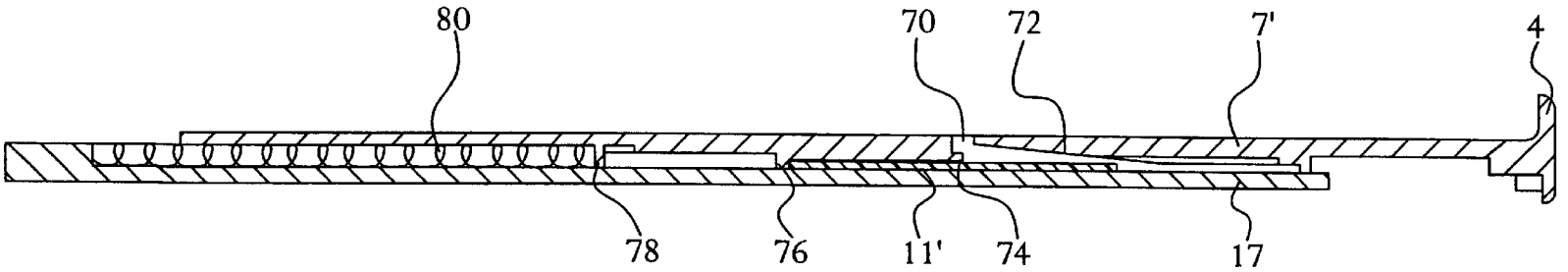
FIG. 11 is a view similar to FIG. 8 particularly showing a fourth possible cooperation stage between locking and unlocking device and movable abutment member.

Finally, FIG. 11 shows the final opening position, where the spring 80 has fully pushed the abutment member 7' out of the box 5, till the lamellar spring 11' has made contact and abutted against the stopper tooth 76.

What is claimed is:

1. Reduced-encumbrance anti-theft case (1) for items (3), particularly for compact disks, musicassettes, videocassettes and the like, comprising:

a box (5) to contain the item (3) to be protected;

a movable abutment member (7, 7') adapted to cooperate with a head (9) of said item (3) when said item (3) is inserted inside said box (5) in order to prevent said item (3) from being extracted from said box (5); and a locking and unlocking device (11, 11') adapted to cooperate with said movable abutment member (7, 7') in order to take said member (7, 7') from an active abutment position wherein said item (3) is unmovably inserted into said box (5) to an inactive releasing position wherein said item (3) is able to be removed from said box (5); characterized in that said box (5) is comprised of:

an upper face (15) substantially shaped as a C, said upper face (15) having maximum overall dimensions that are slightly greater than said item (3) to be protected;

a lower face (17) substantially shaped as a C, said lower face (17) having maximum overall dimensions that are slightly greater than said item (3) to be protected;

a rear holding wall (19), said rear holding wall (19) being connected to two corresponding longer sides (21, 23), respectively, of the C of said upper and lower faces (15, 17); and two elongated front holding walls (25, 27), a first one (25) of said front holding walls (25, 22) being connected to two corresponding ends (29, 31), respectively, of one (33, 35) of the two shorter arms of the C respectively of said upper and lower faces (15, 17), a second one (27) of said front holding walls (25, 27) being connected to two corresponding ends (37, 39), respectively, of another one (41, 43) of the two shorter arms of the C respectively of said upper and lower faces (15, 17), the second one (27) of said front holding walls (25, 27) having a cross section shaped as an L so that an arm (45) of the L of said wall (27) abuts against said item (3) when said item (3) is completely inserted into said case (1) in order to prevent said item (3) from being removed from said case (1);

wherein said reduced-encumbrance anti-theft case (1) is characterized in that said movable abutment member (7, 7') is connected to said lower face (17) in a longitudinally sliding way with respect to a plane of said box (5), said movable abutment member (7, 7') being shaped as a C that is substantially similar to the C-shape of said lower face (17), said movable abutment member (7, 7') being equipped with a side engagement end (47) positioned with respect to said box (5) on an opposite side with respect to a side where said second front holding wall (27) is provided, said side engagement end (47) being adapted to cooperate with said head (9) of said item (3) in order to prevent said item (3) from being removed from said case (1) when said item (3) has been completely inserted into said case (1).

2. Reduced-encumbrance anti-theft case (1) according to claim 1, characterized in that said locking and unlocking device (11) is located on said lower face (17) externally to said box (5).

3. Reduced-encumbrance anti-theft case (1) according to claim 2, characterized in that said locking and unlocking device (11) is comprised of a small cylinder (11) included inside a cylindrical seat (13), said locking and unlocking device (11) being adapted to be inserted, in a locking stage, into a hole (14) formed into said movable abutment member (7), said locking and unlocking device (11) being adapted to be taken out, in an unlocking stage, from said hole (14).

4. Reduced-encumbrance anti-theft case (1) according to claim 1, characterized in that said locking and unlocking device (11') is located on said lower face (17) internally to said box (5).

5. Reduced-encumbrance anti-theft case (1) according to claim 4, characterized in that said locking and unlocking device (11') is comprised of a lamellar spring (11') fixed on one end to said lower face (17), said locking and unlocking device (11') being adapted to be inserted, in a locking stage, into a recess (70) formed in said movable abutment member (7'), said locking and unlocking device (11') being adapted to be taken out, in an unlocking stage, from said recess (70).

6. Reduced-encumbrance anti-theft case (1) for items (3), particularly for compact disks, musicassettes, videocassettes and the like, comprising:

a box (5) to contain the item (3) to be protected;

a movable abutment member (7, 7') adapted to cooperate with a head (9) of said item (3) when said item (3) is inserted inside said box (5) in order to prevent said item (3) from being extracted from said box (5); and a locking and unlocking device (11, 11') adapted to cooperate with said movable abutment member (7, 7') in order to take said member (7, 7') from an active abutment position wherein said item (3) is unmovably inserted into said box (5) to an inactive releasing position wherein said item (3) is able to be removed from said box (5); characterized in that said box (5) is comprised of:

an upper face (15) substantially shaped as a C, said upper face (15) having maximum overall dimensions that are slightly greater than said item (3) to be protected;

a lower face (17) substantially shaped as a C, said lower face (17) having maximum overall dimensions that are slightly greater than said item (3) to be protected;

a rear holding wall (19), said rear holding wall (19) being connected to two corresponding longer sides (21, 23), respectively, of the C of said upper and lower faces (15, 17); and two elongated front holding walls (25, 27), a first one (25) of said front holding walls (25, 27) being connected to two corresponding ends (29, 31), respectively, of one (33, 35) of the two shorter arms of the C respetively of said upper and lower faces (15, 17), a second one (27) of said front holding walls (25, 27) being connected to two corresponding ends (37, 39), respectively, of another one (41, 43) of the two shorter arms of the C respectively of said upper and lower faces (15, 17), the second one (27) of said front holding walls (25, 27) having a cross section shaped as an L so that an arms (45) of the L of said wall (27) abuts against said item (3) when said item (3) is completely inserted into said case (1) in order to prevent said item (3) from being removed from said case (1);

wherein said reduced-encumbrance anti-theft case (1) is characterized in that said movable abutment member (7, 7') is connected to said lower face (17) in a longitudinally sliding way with respect to a plane of said box (5), said movable abutment member (7, 7') being shaped as a C that is substantially similar to the C-shaped of said lower face (17), said movable abutment member (7, 7') being equipped with a side engagement end (47) positioned with respect to said box (5) on an opposite side with respect to a side where said second front holding wall (27) is provided, said side engagement end (47) being adapted to cooperate with said head (9) of said item (3) in order to prevent said item (3) from being removed from said case (1) when said item (3) has been completely inserted into said case (1);

wherein said reduced-encumbrance anti-theft case (1) is characterized in that said locking and unlocking device (11') is located on said lower face (17) internally to said box (5);

wherein said reduced-encumbrance anti-theft case (1) is characterized in that said locking and unlocking device (11') is comprised of a lamellar spring (11') fixed on one end to said lower face (17), said locking and unlocking device (11') being adapted to be inserted, in a locking stage, into a recess (70) formed in said movable abutment member (7'), said locking and unlocking device (11') being adapted to be taken out, in an unlocking stage, from said recess (70); and wherein said reduced-encumbrance anti theft case (1) is characterized in that said recess (70) is equipped with a projection (74), said projection (74) enabling said locking and unlocking device (11') to be removed from said recess (70) only by applying a force to said movable abutment member (7'), said force being directed inside said case (1).

7. Reduced-encumbrance anti-theft case (1) according to claim 5 or 6, characterized in that said movable abutment member (7') is equipped with a first tooth (76), said tooth (76) abutting against a free end of said lamellar spring (11') to stop said movable abutment member (7') from being completely removed from said box (5), said movable abutment member (7') being further equipped with a second tooth (78), said tooth (78) keeping a spring (80) engaged against said abutment member (7'), said spring (80) providing an outward-pushing force to said abutment member (7').

8. Reduced-encumbrance anti-theft case (1), according to any one of the previous claims 1–6 characterized in that said rear holding wall (19) is adapted to contain electronic signalling devices, said devices being provided against a theft of said item (3).

* * * * *

UNITED STATES PATENT AND TRADEMARK OFFICE

CERTIFICATE OF CORRECTION

PATENT NO. : 6,155,087

DATED : DECEMBER 5, 2000

INVENTOR(S) : PIETRO NECCHI

It is certified that error appears in the above-identified patent and that said Letters Patent are hereby corrected as shown below:

In column 3 line 27, delete the word "an" and replace with --a--.
In column 7 line 40, delete the number "22" and replace with --27--.
In column 8 line 67, delete the word 'arms" and replace with --arm--.
In column 9 line11, delete the phrase "C-shaped" and replace with --C-shape--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*